United States Patent [19]

Vida et al.

[11] 4,134,039

[45] Jan. 9, 1979

[54] HIGH-PRESSURE GAS DISCHARGE LIGHT SOURCE

[75] Inventors: Denes Vida; Ferenc Nagel; Endre Oldal; Laszlo Ugrosdy, all of Budapest, Hungary

[73] Assignee: Egyesult Izzolampa es Villamossagi Reszvenytarsasag, Budapest, Hungary

[21] Appl. No.: 785,075

[22] Filed: Apr. 6, 1977

[30] Foreign Application Priority Data

Apr. 7, 1976 [HU] Hungary ..... EE 2417

[51] Int. Cl.[2] ..... H01J 61/12

[52] U.S. Cl. ..... 313/229; 313/225

[58] Field of Search ..... 313/229, 225

[56] References Cited

U.S. PATENT DOCUMENTS

| | | | |
|---|---|---|---|
| 3,654,506 | 4/1972 | Kuhl et al. | 313/229 X |
| 3,842,307 | 10/1974 | Dobrusskin et al. | 313/229 X |

*Primary Examiner*—Rudolph V. Rolinec
*Assistant Examiner*—Darwin R. Hostetter

[57] ABSTRACT

A high-pressure gas discharge light source with high light conversion efficiency and color rendering, having a translucent discharge vessel of high melting point material in which electrodes of high melting point material are suspended and containing a filling of an inert gas or a mixture of inert gases, at least one metal halide and optionally one or more metals in the elemental state under cold conditions, wherein the ratio of the metal to the halogen forming the halide is stoichiometric or greater, and the specific wall load factor is between 25 and 200 W/cm$^2$ and/or the quantity of the halide or halides is 0.01 to 1 mg per centimeter length of the arc.

18 Claims, 1 Drawing Figure

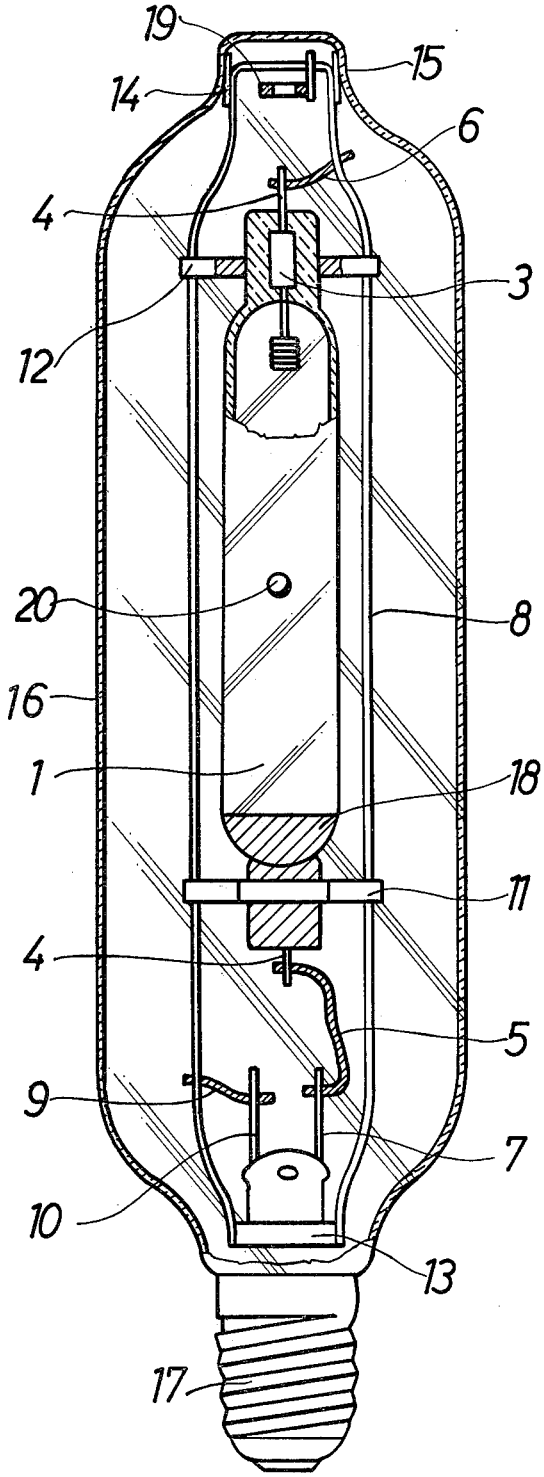
19
15
14
6
4
3
12
20
8
16
1
18
11
4
5
9
7
10
13
17

HIGH-PRESSURE GAS DISCHARGE LIGHT SOURCE

This invention relates to a high-pressure gas discharge light source comprising a translucent discharge vessel made of high melting point material into which electrodes having a high melting point project and which contains and inert gas or a mixture of inert gases and the halide of at least one metal, and in a given case, one or more metals which under the operating conditions are in the elemental state under cold conditions.

There are already known high pressure gas discharge light sources which, in order to improve their luminous efficacy and color rendering, contain, in addition to mercury and inert gas, one or more metal halides. Such light sources are described in, e.g., German Patent Specification Nos. 1,184,008 and 1,940,539.

According to experience, the life of lamps with one or more metal halide additives is limited by the thermal and chemical destruction of the discharge vessel due to operation for long periods at high temperatures.

It is the general opinion in the art that the rate of destruction of the discharge vessel is proportional to the so-called specific wall load of the discharge vessel, also referred to herein as the arc tube. The wall load is to be understood as the ratio of the power input to the inner surface area of the discharge vessel surrounding the arc.

In this field there are known light sources with particularly short lives (e.g., German Patent Specification No. 1,940,539) with relatively high specific wall loads (10–100 W/cm$^2$) wherein these high specific wall loads are made possible by adding halogens in elemental form to the metal halides in the discharge vessel. Due to an excess of halogen, such light sources have a very high ignition voltage, and in addition intensive corrosion arises at the current lead-in parts of the electrodes and this further contributes to the shortening of lamp life.

Generally, in order to obtain longer light source lives, the aim has been to keep the specific wall load at a low level, e.g., according to German Patent Specification No. 1,184,008 in which the highest permissible value is given as 25 W/cm$^2$, but the value of the specific wall load of lamps actually produced is generally 10–15 W/cm$^2$.

At the same time, the relatively low specific wall load has made it necessary to use abundant quantities of halide additives. If only small quantities of additives were present, the halide additives were deposited on the coldest parts of the discharge vessel and an insufficient amount of metal atoms reached the gas space owing to the low vapor pressure. If the metal halides were dosed in abundance, the additive formed a thick liquid phase of large surface area with the part of the surface facing the arc being warmer than the wall temperature of the arc tube, as a consequence of which its vapor pressure was also higher. Although the metal halide also condenses on the colder parts of the discharge vessel in this case, it can nevertheless pass on to a warmer spot. Thus the vapor pressure in the lamp is, in fact, higher than would be allowed by the temperature of the coldest part. However, experience has shown that the life of lamps designed on this principle is still limited by the thermal destruction of the discharge vessel. In lamps with a specific wall load of 10–15 W/cm$^2$ containing large quantities of additives, the arc in the tube is generally not positioned along the axis of the tube but bows out off the axis towards the wall of the tube and is disposed close to the wall. This deflection is caused by the convection generated in the discharge vessel and by the uneven distribution of the condensed phase in the vessel. An additional cause may be the effect of the magnetic field of the external lead-in current conductors.

Several suggestions can be found in the technical literature for reducing the bowing or deflection of the arc. One of these utilizes the effect of the magnetic field of the current lead-in conductors to compensate for the bowing of the are caused by convection (See P. C. Drop, J. J. De Grool, A. G. Jack, G. C. Ronwelcz: Journal of Lighting Research and Technology, 5th May 1974, No. 4, pages 212–216). According to another suggestion, by suitable bending of the arc tube, thermal conditons can be created which are conducive to the reduction of convection (See F. Koury, W. C. Gungle, and J. F. Waymouth: Journal of IES, January 1975, pages 106–110). The disadvantage of both these solutions is that they substantially limit the possible operating positions of the lamp because the effect of compensation is achieved only in very limited positions of the lamp.

An object of the invention is the reduction or elimination of these deficiencies of the lamps caused by thermal destruction or damage to the discharge vessel, and at the same time also to improve other parameters of lamp quality.

This object is achieved in a manner which may be surprising even for the expert by increasing the specific wall load by selecting it to lie in the range of 25–200 W/cm$^2$ and/or by selecting the dosage of the different metal halides so that each of them separately amounts to 0.01–1 mg per centimeter length of arc.

According to the present invention, therefore, there is provided a high-pressure gas discharge light source comprising a translucent discharge vessel of high melting point material fitted with electrodes of high melting point material and containing a filling of an inert gas or a mixture of inert gases, at least one metal halide, and optionally one or more metals in the elemental state under cold conditions, wherein the ratio of the metal to the halogen forming the halide is stoichiometric or greater, and the specific wall load factor is between 25–200 W/cm$^2$ and/or the quantity of each of the metal halides is 0.01–1 mg per centimeter length of the arc.

Surprisingly, we found that the thermal destruction of the discharge vessel can be slowed down not only by reduction of the specific wall load but, to the contrary, also by an increase of the specific wall load and/or by a reduction in the quantity of metal halide additives brought into the discharge vessel. This surprising discovery may be explained (although we do not wish to be bound by this) by the recognition of the fact that the cause of the destruction of the discharge vessel is not the average load but the local overload of the wall. If therefore the wall load is made more uniform, the average wall load may be increased without the specific local wall load being increased beyond the value tolerable to attain the desired life of the lamp.

By means of the measures proposed in accordance with this invention, the specific wall load tends to become more uniform because these measures have an influence on the appearance of the arc, namely that the arc will not be bowed. Convection is, of course, decisively influenced by the wall load and/or the quantity of halide additives. By means of the measures taken according to the invention, i.e., the increase of the specific wall load and/or the reduction of the halide additives, a more uniform temperature distribution can be achieved. This has the result that the so-called "cold spot" temperature is also increased, thus increasing the vapor pressure of the additives. Consequently, there is no longer any need for providing, as in the above-described prior art solutions, a large quantity of liquid phase.

A good stability of color rendering and of light emission together with a neutral, stable behavior and lack of sensitivity towards external influences, e.g., a sudden drop of the supply voltage, interference from internal or external magnetic fields, etc., are additional advantages of light sources according to the invention.

The specific wall load cannot be increased without limit, because the whole inside surface of the arc tube would reach such a high temperature that, sooner or later, total thermal destruction of the vessel would result. The permissible upper limit depends on several factors, e.g., on the designed life, the material of the vessel, the dosage of additives, etc., but according to our experience it should not exceed 200 $W/cm^2$.

The invention enables light sources having the abovedescribed advantages to be produced; in such light sources metals with high vapor pressure, e.g., mercury can be used, so that at least one of the metal additives employed belongs to the third column and/or at least one of the metal additives belongs to the first column of the Periodic Table. Expediently, such a light source might contain (as metal additives) dysprosium and/or holmium and as further additional additives sodium, thallium and indium.

The essence of the invention is described in conjunction with a preferred embodiment with reference to the single figure of the accompanying drawing, which is a cross-section of a discharge lamp.

The discharge lamp shown in the drawing has a discharge vessel (arc tube) 1 made of quartz and is fitted at both of its extremities with similar electrodes, of which one designated 2 is shown, made of tungsten activated with thorium. The electrodes 2 are connected via molybdenum foil members 3 to current lead-in wires 4 also made of molybdenum and connected via flexible nickel braids 5 and 6, respectively, to an external current conductor 7 and a support 8 made of molybdenum. The support 8 is connected by a nickel braid 9 to the other external current conductor 10. The discharge vessel 1 is secured by stainless steel yokes 11, 12 to the support 8, and this latter is supported by a yoke 13 and by resilient plates 14 and 15. The bulb or envelope 16 is made of hard glass and is fitted with a cap 17. To minimize heat losses the discharge vessel is coated externally at both ends with a suitable coating, expediently of zirconia. A getter 19 made of a zirconium-aluminum alloy is disposed in the envelope 16.

The internal diameter of one embodiment of the discharge vessel is 2.2 cm, the distance between electrodes being 8.5 cm. The specific wall load is 34 $W/cm^2$. The filling of the discharge vessel consists of 25 Torr Ar, 86 mg Hg, 1 mg Dy, 1 mg Ho, 8 mg $HgI_2$, 4 mg $TlJ_2$, 3 mg CsJ. After being filled with these additives, the discharge tube is vacuum sealed by tipping off the exhaust tube 20. The outer bulb is filled with nitrogen with a filling pressure of 300 Torr as measured at room temperature.

During operation of the lamp a chemical reaction takes place between the dysprosium and holmium and the iodine of the mercury iodide to form dysprosium iodide and holmium iodide, as follows:

$$2M + 3HgI_2 = 2MI_3 + 3Hg$$

where M represents dysprosium and holmium.

From the point of view of the invention it is immaterial whether the specified elements are introduced in the form of their iodides or in their elemental form. The reaction takes place only after the lamp is switched on. Operating the lamp described above at a main voltage of 38OV and 50 Hz with a suitable choke-coil at a current load of 10.3A an output of 2000W has been achieved. The luminous efficacy is 85 lm/W, the color temperature is 6000° K. and the life performance in a horizontal operating position, is more than 8000 hours.

Although the invention has been illustrated and described with reference to a single preferred embodiment, it is to be expressly understood that it is in no way limited by the disclosure of such a preferred embodiment, but is capable of numerous modifications within the scope of the appended claims.

What is claimed is:

1. A high-pressure gas discharge light source comprising a translucent discharge vessel of high melting point material in which electrodes of high melting point material are suspended, and containing a filling of inert gas, at least one metal halide, the ratio of the metal to the halogen forming the halide being at least stoichiometric, and the specific wall load factor being between 25–200 $W/cm^2$, and wherein the vessel contains at least one metal in its elemental state under cold conditions.

2. A high-pressure gas discharge light source according to claim 1, wherein the metal present in its elemental state is mercury.

3. A high-pressure gas discharge light source according to claim 1, wherein the halide-forming metal is one of the elements of column III of the Periodic Table.

4. A high-pressure gas discharge light source according to claim 1, wherein there is at least one halide-forming metal belonging to column III of the Periodic Table and at least one halide-forming metal belonging to column I of the Periodic Table.

5. A high-pressure discharge light source according to claim 4, wherein the said halide-forming metal is chosen from the group consisting of dysprosium, holmium, thallium and cesium.

6. A high-pressure gas discharge light source according to claim 4, wherein the said halide-forming metal is chosen from the group consisting of thallium, indium, and sodium.

7. A high-pressure gas discharge light source comprising a translucent discharge vessel of high melting point material in which electrodes of high melting point material are suspended and containing a filling of inert gas, at least one metal halide, the ratio of the metal to the halogen forming the halide being at least stoichiometric, and the quantity of each metal halide being 0.01–1 mg per centimeter length of the arc, wherein the vessel contains at least one metal in its elemental state under cold conditions.

8. A high-pressure gas discharge light source according to claim 7, wherein the metal present in its elemental state is mercury.

9. A high-pressure gas discharge light source according to claim 7, wherein the halide-forming metal is one of the elements of column III of the Periodic Table.

10. A high-pressure gas discharge light source according to claim 7, wherein there is at least one halide-forming metal belonging to column III of the Periodic Table and at least one halide-forming metal belonging to column I of the Periodic Table.

11. A high-pressure discharge light source according to claim 10, wherein the said halide-forming metal is chosen from the group consisting of dysprosium, holmium, thallium and cesium.

12. A high-pressure gas discharge light source according to claim 7, wherein the said halide-forming metal is chosen from the group consisting of thallium, indium and sodium.

13. A high-pressure gas discharge light source comprising a translucent discharge vessel of high melting point material in which electrodes of high melting point material are suspended and containing a filling of inert gas, at least one metal halide, the ratio of the metal to the halogen forming the halide being at least stoichiometric, the specific wall load factor being between 25–200 $W/cm^2$, and the quantity of each metal halide being 0.01–1 mg per centimeter length of the arc, and wherein the vessel contains at least one metal in its elemental state under cold conditions.

14. A high-pressure gas discharge light source according to claim 13, wherein the metal present in its elemental state is mercury.

15. A high-pressure gas discharge light source according to claim 13, wherein the halide-forming metal is one of the elements of column III of the Periodic Table.

16. A high-pressure gas discharge light source according to claim 13, wherein there is at least one halide-forming metal belonging to column III of the Periodic Table and at least one halide-forming metal belonging to column I of the Periodic Table.

17. A high-pressure discharge light source according to claim 16, wherein the said halide-forming metal is chosen from the group consisting of dysprosium, holmium, thallium and cesium.

18. A high-pressure gas discharge light source according to claim 16, wherein the said halide-forming metal is chosen from the group consisting of thallium, indium and sodium.

* * * * *